US011426785B2

(12) United States Patent
Hoehne et al.

(10) Patent No.: US 11,426,785 B2
(45) Date of Patent: Aug. 30, 2022

(54) METHOD FOR THE FORMING MANUFACTURING OF A GEAR TOOTHING AND TOOL DEVICE FOR THE CALIBRATION OF THE GEAR CUTTING INLET AND/OR GEAR CUTTING OUTLET

(71) Applicant: ZF Friedrichshafen AG, Friedrichshafen (DE)

(72) Inventors: Peter Hoehne, Friedrichsthal (DE); Joerg Brockstieger, Kleinblittersdorf (DE)

(73) Assignee: ZF FRIEDRICHSHAFEN AG, Friedrichshafen (DE)

( * ) Notice: Subject to any disclaimer, the term of this patent is extended or adjusted under 35 U.S.C. 154(b) by 610 days.

(21) Appl. No.: 16/061,405

(22) PCT Filed: Nov. 24, 2016

(86) PCT No.: PCT/EP2016/078641
§ 371 (c)(1),
(2) Date: Jun. 12, 2018

(87) PCT Pub. No.: WO2017/108319
PCT Pub. Date: Jun. 29, 2017

(65) Prior Publication Data

US 2020/0261961 A1 Aug. 20, 2020

(30) Foreign Application Priority Data

Dec. 21, 2015 (DE) ..... 10 2015 226 364.9

(51) Int. Cl.
*B21D 53/28* (2006.01)
*B21J 5/12* (2006.01)
(Continued)

(52) U.S. Cl.
CPC ..... *B21D 53/28* (2013.01); *B21J 5/08* (2013.01); *B21J 5/12* (2013.01); *B21J 13/02* (2013.01); *B21K 1/30* (2013.01)

(58) Field of Classification Search
CPC ..... B21J 5/06; B21J 5/08; B21J 5/12; B21J 9/06; B21J 9/02; B21J 13/02; B21K 1/30;
(Continued)

(56) References Cited

U.S. PATENT DOCUMENTS 3,796,106 A * 3/1974 Fisher ..... B21D 53/28 474/152
6,007,762 A * 12/1999 Amateau ..... B21H 5/022 266/118
2015/0117943 A1 4/2015 Keppler-Ott et al.

FOREIGN PATENT DOCUMENTS

DE 2225466 C3 1/1973
DE 102009019249 B4 3/2011
(Continued)

OTHER PUBLICATIONS

German Search Report DE102015226364.9 dated Aug. 22, 2016. (8 pages).
(Continued)

*Primary Examiner* — Jessica Cahill
*Assistant Examiner* — Bobby Yeonjin Kim
(74) *Attorney, Agent, or Firm* — Dority & Manning, P.A.

(57) ABSTRACT

A method for manufacturing a gear toothing on a metallic workpiece and a tool device for calibration of a gear toothing inlet and/or a gear toothing outlet of a gear of the metallic workpiece. The method includes producing the gear toothing by forming manufacturing and performing a compression process to calibrate a gear toothing inlet and/or a gear toothing outlet of the gear toothing, wherein a gear tooth shape and a gear tooth length are adjusted during the compression process. The tool device includes a workpiece
(Continued)

location for accommodating the workpiece, an axially movable die selectively engageable with the gear toothing, the die supporting the gear toothing and predefining the gear tooth shape to be adjusted on the gear toothing inlet and/or on the gear toothing outlet, and at least one axially movable compression ring which calibrates the gear toothing inlet and/or gear toothing outlet by a compression process.

15 Claims, 3 Drawing Sheets

(51) Int. Cl.

| | |
|---|---|
| ***B21J 13/02*** | (2006.01) |
| ***B21K 1/30*** | (2006.01) |
| ***B21J 5/08*** | (2006.01) |

(58) Field of Classification Search
CPC ..... B21H 5/022; B21H 5/045; B21H 5/00; B21H 5/02; B21H 5/025; B21D 53/28; B21D 24/005
See application file for complete search history.

(56) References Cited

FOREIGN PATENT DOCUMENTS

| | | | | | |
|---|---|---|---|---|---|
| DE | 102010017592 | A1 | | 12/2011 | |
| DE | 102010053547 | A1 | | 6/2012 | |
| EP | 2561938 | A1 | | 2/2013 | |
| JP | H0749132 | B2 | * | 5/1995 | ..... B21H 5/00 |
| WO | WO 2011/160809 | A1 | | 12/2011 | |
| WO | WO-2011160809 | A1 | * | 12/2011 | ..... B21D 53/28 |
| WO | WO 2013/149271 | A1 | | 10/2013 | |

OTHER PUBLICATIONS

International Search Report (English Translation) PCT/EP2016/078641, dated Jan. 20, 2017, (2 pages).

* cited by examiner

METHOD FOR THE FORMING MANUFACTURING OF A GEAR TOOTHING AND TOOL DEVICE FOR THE CALIBRATION OF THE GEAR CUTTING INLET AND/OR GEAR CUTTING OUTLET

FIELD OF THE INVENTION

The invention relates generally to a method for the forming manufacturing of a gear toothing on a metallic workpiece and to a tool or a tool device for the forming calibration of the gear toothing inlet and/or the gear toothing outlet of a gear toothing on a metallic workpiece.

BACKGROUND

On metallic workpieces, gear toothings are producible by machining (for example, by gear milling) or by forming (for example, by axial forming or gear rolling). The forming production of a gear toothing frequently has the disadvantage that an undefined deformation occurs on the gear toothing inlet (also referred to as the gear cutting inlet), in particular, however, on the gear toothing outlet (also referred to as the gear cutting outlet), wherein so-called gear tooth overhangs form on the gear toothing outlet, in particular, which must be subsequently removed, for example, by elaborate re-working by machining.

SUMMARY OF THE INVENTION

The object of the present invention is to provide a method for forming manufacturing a gear and a tool for calibrating the gear cutting inlet and/or the gear cutting outlet.

According to the invention, the method for manufacturing a gear toothing on a metallic workpiece provides that the gear toothing is initially produced by forming and, subsequently, the gear toothing produced by forming is calibrated on its gear toothing inlet and/or gear toothing outlet by a compression process in which the gear tooth shape as well as the gear tooth length are adjusted (on the gear toothing inlet or outlet).

The gear toothing is produced by axial forming, for example, wherein the workpiece and a shaping die or matrix or the like are moved relative to each other in the axial direction. As described above, undefined deformations can occur, in this case, on the gear toothing inlet (first point of contact between the workpiece and the matrix, which forms the start of the gear tooth) and/or on the gear toothing outlet (the end of the gear tooth opposite the gear toothing inlet), which is unfavorable for many reasons.

In the compression process provided according to the invention (forming by axially acting compressive forces), the gear toothing is calibrated on the gear toothing inlet and/or on the gear toothing outlet, wherein the gear tooth shape (the shape of the tooth and the tooth gap) as well as the tooth length are adjusted in the applicable area. Any gear tooth overhangs are compressed to a defined dimension, wherein the material flows not only in the axial direction, but also in the radial direction. This has the advantage, furthermore, that the supporting section or the supporting length of the gear toothing is also enlarged, and therefore the structural gear tooth length can be reduced, if necessary. After the compression process, the gear toothing is ready for use, i.e., further machining steps are not provided (i.e., no further machining costs). The gear toothing can be running gearing. In particular, the gear toothing is a spline.

The compression does not take place freely, but rather in a guided manner. For this purpose, the gear toothing may be supported during compression by a die which includes a corresponding toothing contour and also predefines the gear tooth shape to be adjusted on the gear toothing inlet and/or on the gear toothing outlet, i.e., the material flowing in the radial direction during compression is brought into the desired shape within the die. The die has a corresponding inside contour or external contour depending on whether the gear toothing to be calibrated on the start side and/or on the end side is external gearing or internal gearing.

The calibration of the gear toothing inlet and/or the gear toothing outlet can be carried out in a separate tool device after the forming production of the gear toothing. In one embodiment, the workpiece to be machined or calibrated is placed into the separate tool device, as explained in greater detail in the following.

The calibration of the gear toothing inlet and/or the gear toothing outlet can be carried out in the gear toothing-producing tool device during the forming production of the gear toothing.

The workpiece can consist of a solid material, for example, a steel material, and is machinable by solid forming. Preferably, the workpiece consists of a sheet material, for example, a steel sheet, and is machined by sheet-metal forming.

The tool device according to the invention for the forming calibration of the gear toothing inlet and/or the gear toothing outlet of a gear toothing on a metallic workpiece generally includes a workpiece location for accommodating the workpiece to be machined, an axially movable die, and at least one axially movable compression ring. The axially movable die is selectively engageable with the gear toothing on the workpiece to be machined and subsequently supports the gear toothing on the workpiece and predefines the gear tooth shape to be adjusted on the gear toothing inlet and/or on the gear toothing outlet during calibration. The at least one axially movable compression ring calibrates the gear toothing inlet and/or the gear toothing outlet on the workpiece to be machined by a compression process (in which the gear tooth shape as well as the gear tooth length are adjusted).

One preferred embodiment provides that the die and the compression ring are both attached to an axially movable punch and are moved or driven together in order to implement a calibration process. This embodiment allows for a simple and robust tool design.

Yet another preferred embodiment provides that the die and the compression ring are attached to different punches and are moved or driven separately. This embodiment allows for improved adjustability of the calibration process.

Preferably, it is provided that the die has a tapered toothing contour. Due to the tapered design, the engagement with the gear toothing on the workpiece (workpiece toothing) to be calibrated on the inlet and/or the outlet is simplified. Furthermore, a defined forming can take place on the gear toothing inlet and/or the gear toothing outlet already formed during the engagement.

Furthermore, it is preferably provided that the die has one rotational degree of freedom, and therefore the die can align itself during the engagement with the workpiece toothing.

A workpiece or a component, for example a gearwheel or the like, which includes a gear toothing manufactured using the method according to the invention and/or with the aid of the tool device according to the invention is distinguished by the fact that this gear toothing, which has been produced by forming, includes a shape- and length-calibrated gear toothing inlet and/or gear toothing outlet. Preferably, the gear toothing includes a straight, i.e., non-pointed, gear toothing inlet and/or gear toothing outlet.

BRIEF DESCRIPTION OF THE DRAWINGS

Preferred embodiments will be explained in greater detail in the following in a non-restrictive way with reference to the figures. The features shown in the figures and/or explained in the following can be general features of the invention and can refine the invention, also independently of specific combinations of features. Features or components that are the same or similar are labeled using the same reference characters. In the drawings, the following is shown.

DETAILED DESCRIPTION

Figure 1:
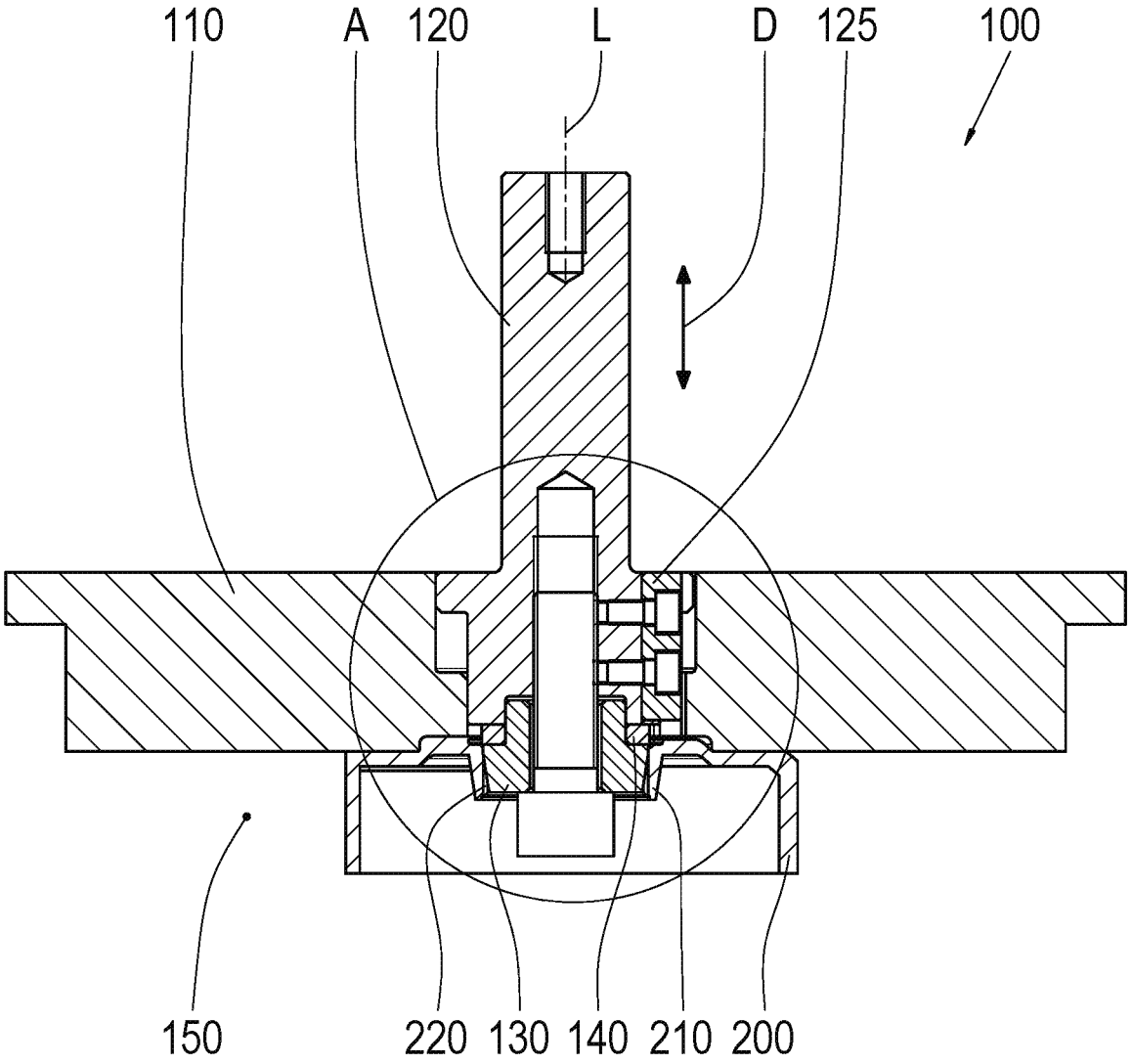
FIG. 1 shows a section view of a sectioning of a tool device for calibrating a gear toothing outlet according to aspects of the present invention.

Reference will now be made to embodiments of the invention, one or more examples of which are shown in the drawings. Each embodiment is provided by way of explanation of the invention, and not as a limitation of the invention. For example, features illustrated or described as part of one embodiment can be combined with another embodiment to yield still another embodiment. It is intended that the present invention include these and other modifications and variations to the embodiments described herein.

The direction and location indications utilized in the following relate, in a non-restrictive way, to the representations shown in the figures.

The section of a tool device 100 according to the invention shown in FIG. 1 includes a holder 110 and a punch 120 longitudinally movably guided therein. A mandrel-like die 130 and a compression ring 140 are attached to the punch 120. The punch 120 is movable together with the die 130 and the compression ring 140 in the axial direction L, as illustrated by the double arrow D. A punch guide and anti-torsion mechanism is marked with 125. The tool 100 is installed in a forming machine (for example, an axial forming machine), by which the punch motion D is also brought about.

FIG. 1 further shows a sheet workpiece 200 including a collar-like pulled-through portion 210, on the inner circumferential surface of which a gear toothing (internal spline) 220 is formed, the gear toothing having been previously produced by forming. The workpiece toothing 220 was produced from the bottom toward the top and includes a lower gear toothing inlet 221 (see FIG. 2), an upper gear toothing outlet 222 (see FIG. 2), and a supporting section lying therebetween. Due to the forming manufacturing, an undefined deformation has occurred on the gear toothing outlet 222, which will now be calibrated with the aid of the die 130 and the compression ring 140. For this purpose, the workpiece 200 is fixed in a workpiece location 150 which belongs to the tool device 100 and is not represented further. The calibration process is explained in greater detail in the following with reference to FIG. 2.

After the workpiece 200 has been placed into the workpiece location 150 and has been fixed in position, the punch 120 is moved, together with the die 130 and the compression ring 140, downward in the axial direction L, wherein the die 130 initially enters the pulled-through portion 210. The die 130 is tapered and, on its tapered outer circumferential surface, has a toothing contour 135 which corresponds to the workpiece toothing 220 and successively enters into engagement with the workpiece toothing 220, with increasing cross-sections, as the punch 120 advances. The axial movement L of the punch 120 and the die 130 attached thereto corresponds to the central axis of the workpiece toothing 220. In order to prevent a misalignment, the die 130 has slight rotational play (rotational degree of freedom) within the tool device 100.

The gear toothing outlet 222, due to its tapered and expanding design in the radial transverse direction R, is already formed during the penetration by the die 130 into the workpiece toothing 220. At the end of the axial advancing motion, the compression ring 140 presses in the axial direction L against the end of the gear toothing on the upper gear toothing outlet 222 of the workpiece toothing 220, wherein compression-forming occurs, in which the workpiece material flows in the axial direction L as well as in the radial direction R and any gear tooth overhangs are reshaped. Furthermore, the individual tooth ends of the gear toothing 220 are leveled and are subsequently located in one plane. In this calibrating compression process, the gear tooth shape and the gear tooth length are adjusted on the gear toothing outlet 222 to a defined dimension (at least in the range of ten percent of the defined dimension).

Figure 2:
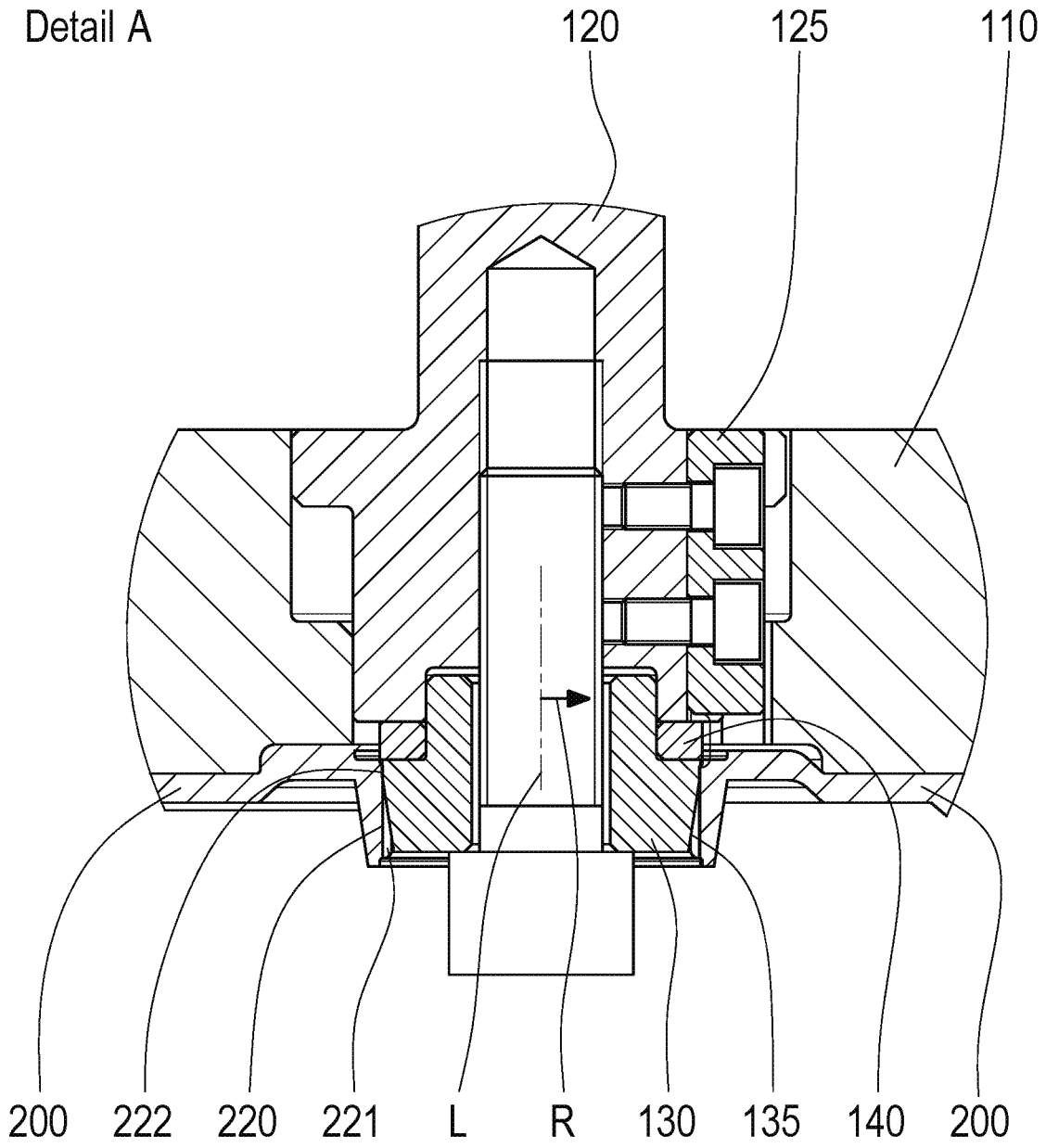
FIG. 2 shows a detail view of section A shown in FIG. 1 according to aspects of the present subject matter.
Figure 3:
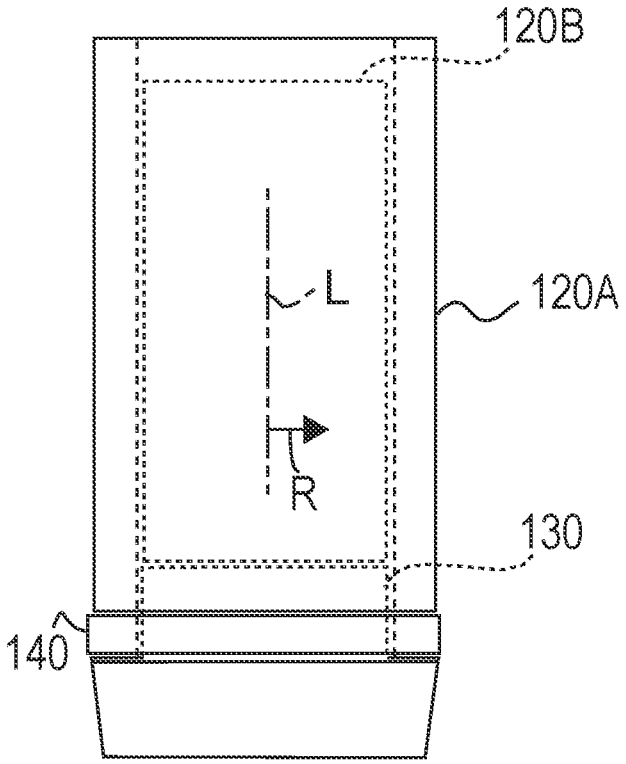
FIG. 3 shows first and second punches suitable for use with a tool device for calibrating a gear toothing outlet according to aspects of the present invention

FIG. 1 and FIG. 2 each show the punch 120 at the end of its axial advancing motion D. The die 130 and the compression ring 140 can also be moved individually, as explained above, in an appropriate embodiment of the tool device 100. For instance, the die 130 and the compression ring 140 are attached to different punches and are moved or driven separately. For example, the die 130 may be coupled to a first punch 120A and the compression ring 140 may be coupled to a second punch 120B as shown schematically in FIG. 3, such that the die 130 and the compression ring 140 may be moved or driven separately of each other along the axial direction L. This embodiment allows for improved adjustability of the calibration process.

In the approach according to the invention, the workpiece toothing 220 is to be calibrated not in entirety, but rather only in areas, i.e., on the gear toothing outlet 222 (as explained above) and/or on the gear toothing inlet 221. During the calibration, the gear toothing 220 is supportable in the sections which are not to be calibrated, in order to prevent an unintentional deformation.

Proceeding from the design option shown in FIG. 1 and FIG. 2 for the calibration of a gear toothing outlet, the toolmaking- and process-related transfer for the calibration of a gear toothing inlet or for an essentially simultaneous calibration of the gear toothing inlet and outlet can be understood by one of ordinary skill in the art.

Modifications and variations can be made to the embodiments illustrated or described herein without departing from the scope and spirit of the invention as set forth in the appended claims.

REFERENCE CHARACTERS

100 tool device
110 holder
120 punch
125 punch guide
130 die
135 toothing contour
140 compression ring

150 workpiece location
200 workpiece
210 pulled-through portion
220 gear toothing
221 gear toothing inlet
222 gear toothing outlet
A detail
D punch motion
L axis of movement (axial direction)
R radial direction

The invention claimed is:

1. A method for manufacturing a gear toothing (220) on a metallic workpiece (200), the method comprising:

producing the gear toothing (220) by forming manufacturing using a gear toothing-producing tool device; and performing a compression process to calibrate one or more of a gear toothing inlet (221) and a gear toothing outlet (222) of the gear toothing (220), the gear toothing inlet (221) and the gear toothing outlet (222) being spaced apart along an axial direction (L), wherein a gear tooth shape is adjusted and a gear tooth overhang on the one or more of the gear toothing inlet (221) and the gear toothing outlet (222) formed during the forming manufacturing is compressed such that a maximum axial gear tooth length along the axial direction (L) is reduced during the performing of the compression process.

2. The method of claim 1, wherein the gear toothing (220) is supported during the performing of the compression process by a die (130), the die (130) predefining the gear tooth shape to be adjusted on the one or more of the gear toothing inlet (221) and the gear toothing outlet (222).

3. The method of claim 1, wherein the workpiece (200) is a sheet material.

4. The method of claim 1, wherein the calibration of the one or more of the gear toothing inlet (221) and the gear toothing outlet (222) is carried out in a separate tool device (100) from the gear toothing-producing tool device.

5. The method of claim 1, wherein the calibration of the one or more of the gear toothing inlet (221) and the gear toothing outlet (222) is carried out in the gear toothing-producing tool device.

6. The method of claim 1, wherein at least one axially movable compression ring (140) is movable in the axial direction (L) to press directly against an axial end of the gear toothing (220) in the axial direction (L) to compress the gear tooth overhang such that the maximum axial gear tooth length along the axial direction (L) is reduced during the performing of the compression process.

7. The method of claim 6, wherein the gear toothing (220) is supported during the performing of the compression process by a die (130), the die (130) predefining the gear tooth shape to be adjusted on the one or more of the gear toothing inlet (221) and the gear toothing outlet (222), wherein the at least one axially movable compression ring (140) presses directly against the die (130) during the compression process.

8. The method of claim 1, wherein the gear tooth overhang is compressed during the compression process such that tooth ends of the gear toothing (220) are leveled into one plane.

9. The method of claim 1, wherein the gear toothing (220) is formed on an inner circumferential surface of a collar of the metallic workpiece (200) during the forming manufacturing.

10. A tool device (100) for calibration of one or more of a gear toothing inlet (221) and a gear toothing outlet (222) of a gear toothing (220) of a metallic workpiece (200), the gear toothing inlet (221) and the gear toothing outlet (222) being spaced apart along an axial direction (L), the tool device (100) comprising:

a workpiece location (150) for accommodating the workpiece (200);

an axially movable die (130) movable along the axial direction (L) is configured to selectively engage with the gear toothing (220) on the workpiece (200), the die (130) supporting the gear toothing (220) on the workpiece (200) and predefining a gear tooth shape to be adjusted on the one or more of the gear toothing inlet (221) and the gear toothing outlet (222) during calibration; and at least one axially movable compression ring (140) movable along the axial direction (L), the at least one axially movable compression ring (140) is configured to calibrate the one or more of the gear toothing inlet (221) and the gear toothing outlet (222) on the workpiece (200) by a compression process, one of the at least one axially movable compression ring (140) is configured to press directly against the axially movable die (130) and an axial end of the gear toothing (220) in the axial direction (L) to compress a gear tooth overhang on the one or more of the gear toothing inlet (221) and the gear toothing outlet (222) formed during forming of the gear toothing (220) such that a maximum axial gear tooth length in the axial direction (L) of the gear toothing (220) is reduced during the compression process.

11. The tool device (100) of claim 10, wherein the die (130) and the compression ring (140) are attached to an axially movable punch (120) such that the die (130), the compression ring (140) and the axially movable punch (120) are configured to be moved together to implement the calibration.

12. The tool device (100) of claim 10, wherein the die (130) and the compression ring (140) are attached to different punches such that the die (130) and the compression ring (140) are separately movable.

13. The tool device (100) of claim 10, wherein the die (130) has a tapered toothing contour (135).

14. The tool device (100) of claim 10, wherein the die (130) has one degree of rotational freedom.

15. The tool device (100) of claim 10, wherein the gear toothing (220) is formed on an inner circumferential surface of a collar of the metallic workpiece (200).

* * * * *